US007685992B2

(12) United States Patent
Weiss et al.

(10) Patent No.: US 7,685,992 B2
(45) Date of Patent: Mar. 30, 2010

(54) METHOD FOR OPERATING AN INTERNAL COMBUSTION ENGINE, AND CONTROL OR REGULATING DEVICE FOR AN INTERNAL COMBUSTION ENGINE

(75) Inventors: Ruediger Weiss, Moetzingen (DE); Andreas Schmidt, Muehlacker (DE); Jean-Marc Tonye Djon, Stuttgart (DE); Jochen Laubender, Markgroeningen (DE); Manfred Dietrich, Markgroeningen (DE); Elias Calva, Stuttgart (DE); Michael Drung, Muehlacker (DE); Karsten Kroepke, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/291,634

(22) Filed: Nov. 11, 2008

(65) Prior Publication Data

US 2009/0157285 A1 Jun. 18, 2009

(30) Foreign Application Priority Data

Dec. 4, 2007 (DE) ..... 10 2007 058 227

(51) Int. Cl.
*F02B 5/00* (2006.01)
*F02N 1/00* (2006.01)

(52) U.S. Cl. ..... 123/305; 123/179.1

(58) Field of Classification Search ..... 123/179.1, 123/179.5, 179.17, 198 F
See application file for complete search history.

(56) References Cited

U.S. PATENT DOCUMENTS

| | | | | |
|---|---|---|---|---|
| 3,902,472 | A * | 9/1975 | Baugelin | 123/179.19 |
| 7,255,081 | B2 * | 8/2007 | Sieber et al. | 123/179.17 |
| 2003/0056774 | A1 * | 3/2003 | Grass et al. | 123/686 |

FOREIGN PATENT DOCUMENTS

DE 10 2004 037 129 A1 3/2006

* cited by examiner

*Primary Examiner*—John T Kwon
(74) *Attorney, Agent, or Firm*—Kenyon & Kenyon LLP

(57) ABSTRACT

In a method for operating a direct-injection internal combustion engine, a position of at least one piston inside a cylinder in which the combustion engine is at a standstill is determined; and a starting cylinder into which fuel is injected first is selected for a start following the standstill. An instantaneous charge of the starting cylinder is determined as a function of a duration of the standstill of the combustion engine. A distance (d) between the piston of the starting cylinder and a specified position of the piston is calculated. A minimum distance of the piston of the selected cylinder is determined as a function of the instantaneous charge; and another cylinder is selected as starting cylinder if the distance (d) between the piston of the starting cylinder and the specified position is less than the minimum distance.

9 Claims, 3 Drawing Sheets

METHOD FOR OPERATING AN INTERNAL COMBUSTION ENGINE, AND CONTROL OR REGULATING DEVICE FOR AN INTERNAL COMBUSTION ENGINE

BACKGROUND OF THE INVENTION

1. Field of the Invention

The present invention relates to a device and a method for operating an internal combustion engine having a plurality of pistons displaceable inside cylinders, in which: fuel is injected directly into the cylinders; a standstill position of at least one piston inside a cylinder in which the internal combustion engine is at a standstill is determined; and a starting cylinder into which fuel is injected first is selected for a start following the standstill.

2. Description of Related Art

Such a method may be used in what is known as a starter-supported direct start of an internal combustion engine of a motor vehicle. In the starter-supported direct startup, the internal combustion engine is to start as quickly as possibly with minimum support of the starter and with the lowest possible noise development. This requires a startup operation to be implemented in such a way that a starter is driving the internal combustion engine for the shortest time possible. To achieve short startup periods, the starting cylinder, i.e., the particular cylinder into which fuel is injected first and which is fired first in the startup of the internal combustion engine is selected in a suitable manner for each startup operation. A compromise between two contradictory effects must be sought in the selection of the starting cylinder. For one, to avoid delays in the startup operation, a starting cylinder should be selected whose piston is as close as possible to a position that is suitable for the injection of fuel into a cylinder and for firing the fuel. For another, however, to obtain an acceptably low probability of a false start, no cylinder should be selected whose piston is too close to a position that is suitable for the injection and the firing. For a false start would go hand-in-hand with a termination and a subsequent new beginning of the startup operation, which would lead to considerable delays in the startup of the internal combustion engine.

From published German patent document DE 10 2004 037 129, a device and a method are known for the control of an internal combustion engine in a startup. In this method, a starting cylinder is determined as a function of the position of the individual pistons within their cylinders. When determining the starting cylinder, the individual cylinders of the internal combustion engine are checked in a sequence that corresponds to a firing sequence, until a suitable cylinder is found.

BRIEF SUMMARY OF THE INVENTION

It is an object of the present invention to provide a method and a device for operating an internal combustion engine, which allows an at least on average even faster startup of the internal combustion engine with the lowest possible support by a starter.

According to the present invention, the time characteristic of the charge of the cylinders is taken into account when selecting the starting cylinder. It is checked whether the distance between the piston of the selected cylinder and the specified position is sufficient to achieve a rapid and reliable startup of the internal combustion engine at the determined instantaneous charge of the starting cylinder. The specified position of the piston preferably corresponds to a top dead center of the piston between a compression stroke and an expansion stroke in a working phase of the particular cylinder.

The charge of a cylinder must be understood to denote a ratio between an air mass actually introduced into the cylinder, and a fixed reference value of an air mass that corresponds to a particular predefined operating state of the internal combustion engine. The charge is a function of the instantaneous operating state of the internal combustion engine. It has a relatively low value, for example, if a pressure in an intake manifold of the internal combustion engine is relatively low. During standstill of the internal combustion engine, the charge of the starting cylinder whose piston is relatively close to top dead center usually decreases since the air compressed in the starting cylinder escapes into an environment of the internal combustion engine due to leaks, in particular between cylinder and piston of the internal combustion engine.

As the charge of the starting cylinder decreases, the conditions for a direct startup using this starting cylinder get increasingly worse. The method according to the present invention models this time characteristic of the charge of the starting cylinder and selects a different starting cylinder as soon as an instantaneous charge determined according to the charge model would most likely no longer suffice for a direct startup using the starting cylinder. In comparison with known methods, it is possible, especially if the duration of the standstill is brief, to select a starting cylinder whose piston is at a relatively low distance from the predefined position. In this way an at least on average faster startup of the internal combustion engine is achievable by the method according to the present invention.

In those instances where the distance between the piston of the starting cylinder and the predefined position is lower than the minimum distance, in order to find the starting cylinder rapidly and with few computational operations, the particular other starting cylinder whose piston is at a greater distance to the predefined position than the piston of the starting cylinder will preferably be selected.

In this context it is preferred to select as starting cylinder the particular other cylinder whose piston is at a distance to the predefined position which differs the least from the distance between the piston of the starting cylinder and the predefined position. In the normally used internal combustion engines, this means that the cylinders must be checked in a sequence that corresponds to a firing sequence of the internal combustion engine. In internal combustion engines having four cylinders, the result is a distance of the piston of the other starting cylinder that exceeds the distance of the piston of the selected cylinder by an amount that typically corresponds to one rotation of a crankshaft of the internal combustion engine about an angle of 180°.

In order to be able to implement the method with even less computational effort, it is especially preferred that a cylinder other than the starting cylinder is selected no more than once. This starting cylinder is then retained irrespective of the duration of the standstill. As an alternative, a different starting cylinder may be selected multiple times one after the other in order to find a cylinder that is suitable for a startup in a step-by-step manner.

According to one example embodiment of the method of the present invention, a check run may be implemented for different successive instants, in which a cylinder other than the starting cylinder is selected if the distance between the piston of the starting cylinder and the predefined position is less than the minimum distance. This takes the time characteristic of the charge of the cylinder into account in an uncomplicated manner. The check run is preferably implemented at periodic intervals. If a startup of the internal combustion engine is requested, then a result of the most recently implemented check run may be utilized without additional delay. That is to say, during operation of the internal combustion engine a starting cylinder determined on the basis of an instantaneous value of the charge is available at all times.

It is preferred that the minimum distance of the piston of the starting cylinder is determined with the aid of a characteristics map. Such a characteristics map may be prepared on the basis of a suitable series of measurements implemented for a particular type of internal combustion engine. From these measured values, value pairs are determined, each value pair having a value of the charge to which a minimum distance is assigned. These value pairs are then used as nodes of the characteristics map.

A dynamic model (charge model) is preferably used to determine the instantaneous charge of the starting cylinder as a function of the duration of the standstill. To determine the charge of the starting cylinder, an initial value of the charge that characterizes a charge of the starting cylinder at an instant when the standstill of the internal combustion engine begins, is preferably determined, and the initial value is reduced in a time-dependent manner, preferably as a function of a time factor, depending on the duration of the standstill. With the aid of such a charge model, the time characteristic of the charge of the starting cylinder is able to be described in a simple manner and with sufficient accuracy. The time factor depends on the nature of the internal combustion engine and may be determined by a series of measurements, for instance. However, it is possible to provide a constant or also a temporally variable time factor. The initial value may be calculated from at least one state variable of the internal combustion engine.

To achieve satisfactory combustion of an air/fuel mixture inside the starting cylinder during the startup, a fuel quantity to be injected into the starting cylinder may be calculated as a function of the instantaneous charge of the starting cylinder at a starting instant. Thus, the charge model is used not only to select the starting cylinder but also to calculate the fuel quantity to be injected into the starting cylinder. This achieves an even more reliable and on average faster startup of the internal combustion engine with an acceptable impact on the environment by exhaust gas of the internal combustion engine.

To start the method, it is possible, for instance, to select as starting cylinder the particular cylinder whose piston is at a minimum distance to the predefined position. In preselecting the starting cylinder as a function of the distance to the predefined position, it is preferred, however, to select the particular cylinder whose piston is closest to the predefined position, which distance, however, is still greater than a predefined preliminary minimum value. The preliminary minimum value may, for instance, be ascertained with the aid of the afore-described characteristics map for determining the minimum distance for a particular specified value of the charge, preferably 100%. This prevents the selection of a starting cylinder whose piston is so close to the predefined position that a rapid startup of the internal combustion engine is unlikely even under optimal conditions. Thus, proceeding on the basis of a relatively advantageous starting cylinder, the method therefore searches for the optimal starting cylinder, so that the starting cylinder is found after a few check runs. If the method is implemented in the manner described above in that a different starting cylinder is selected no more than once, then the preselection makes it possible for the method to determine a starting cylinder that in most cases is more suitable for the startup than would be the case without the preselection.

A control or regulating device for an internal combustion is provided in accordance with the present invention, which device is a programmable control or regulating device that includes storage means to store a program for executing a method according to the present invention. The storage means may advantageously also be used to store the afore-described characteristics maps in case they are provided. Furthermore, the computational operations required to implement the method according to the present invention may be carried out in a particularly simple manner with the aid of a programmable control or regulating device. It is therefore possible to realize the aforementioned advantages of the method according to the present invention in an uncomplicated manner with the aid of the control or regulating device.

DETAILED DESCRIPTION OF THE INVENTION

Figure 1:
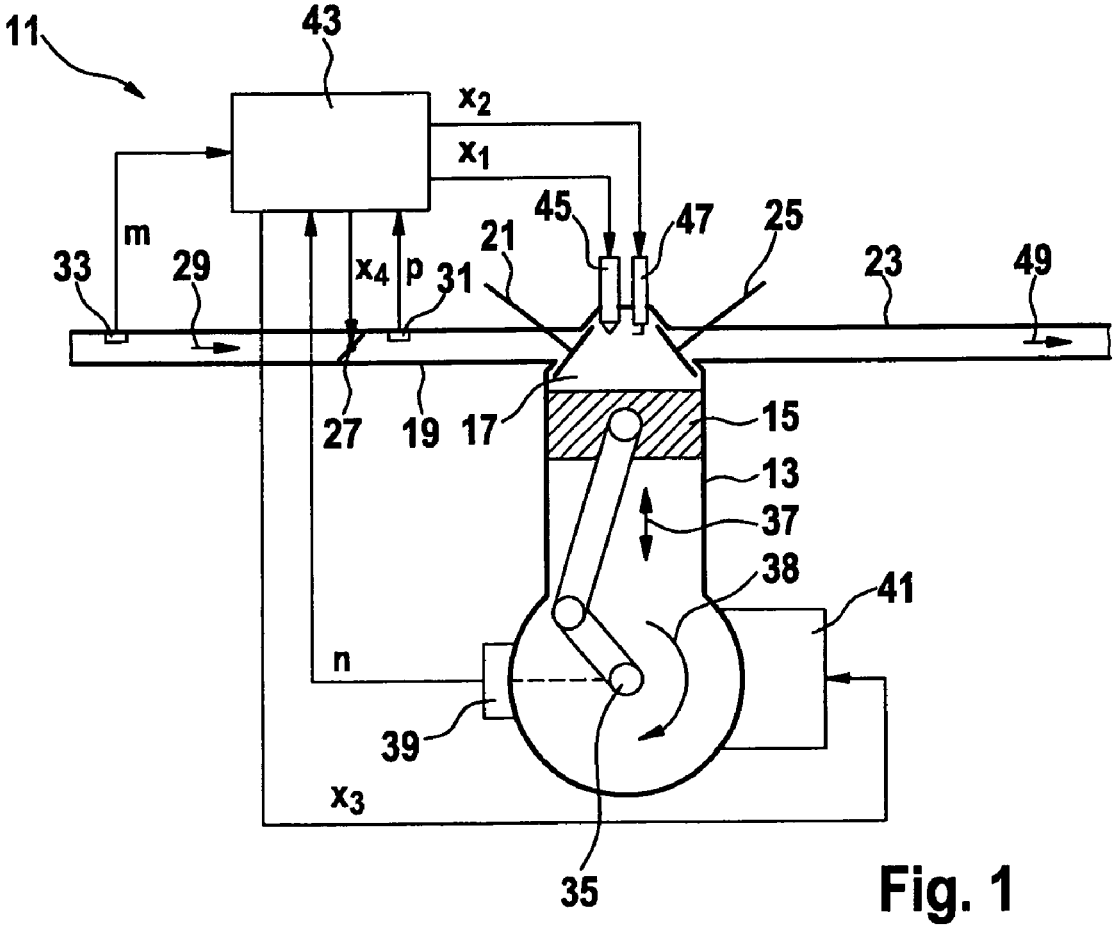
FIG. 1 shows an internal combustion engine having a control or regulating device, in a schematic representation.

FIG. 1 shows an internal combustion engine 11 of a motor vehicle having a piston 15 which is able to move back and forth inside a cylinder 13. In addition, internal combustion engine 11 has three further cylinders with pistons that are able to be moved back and forth inside these cylinders. Therefore, it is a 4-cylinder internal combustion engine 11. The three additional cylinders and the three additional pistons are not shown in FIG. 1 for reasons of clarity.

Cylinder 13 and piston 15 delimit a combustion chamber 17, which is disposed above piston 15 inside cylinder 13 in the illustration of FIG. 1. Furthermore, an intake valve 21 is provided between an intake manifold 19 of internal combustion engine 11 and combustion chamber 17, intake manifold 19 being connected to combustion chamber 17 when intake valve 21 is open. In addition, internal combustion engine 11 includes an exhaust pipe 23, and a discharge valve 25 is disposed between combustion chamber 17 and exhaust pipe 23. When outlet valve 25 is open, combustion chamber 17 is connected to exhaust pipe 23. The exhaust pipe is part of an exhaust-gas system (without reference numeral), which, in addition to exhaust pipe 23, may also include additional components (not shown) such as at least one catalytic converter, at least one Lambda sensor, and/or at least one temperature sensor, for example.

Inside intake manifold 19 there is a throttle device 27 to control a mass flow of the air flowing through intake manifold 19 (arrow 29). A pressure sensor 31 to detect an intake-manifold pressure p is situated in intake manifold 19 between throttle device 27 and intake valve 21. In relation to the flow direction of the air (arrow 29), an air-mass flow sensor 33 for detecting a mass flow of the air flowing through intake manifold 19 (arrow 29) is situated in intake manifold 19 in front of throttle device 27. In one embodiment (not shown), internal combustion engine 11 has even more sensors, such as temperature sensors or additional pressure sensors, for example.

Piston 15 is mechanically linked to a crankshaft 35 of internal combustion engine 15, in such a way that a back-and-forth movement (arrow 37) of piston 15 corresponds to a rotary motion (arrow 38) of crankshaft 35. Crankshaft 35 is connected to an angle-of-rotation sensor 39 in order to detect a rotational angle of crankshaft 35. Due to the coupling of piston 15 to crankshaft 35, each rotational angle of crankshaft 35 corresponds to a specific position of piston 15 inside cylinder 13.

Furthermore, internal combustion engine 11 is equipped with an electric starter 41, with whose aid internal combustion engine 11 is able to be driven. Additionally, internal combustion engine 11 has a control or regulating device 43. Control or regulating device 43 is connected to a fuel injector 45 for the injection of fuel into combustion chamber 17 in such a way that it is able to trigger fuel injector 45 for its opening and closing with the aid of a first trigger signal $x_1$. Furthermore, the control or regulating device is connected to a spark plug 47, which projects into combustion chamber 17, and is able to trigger spark plug 47 with the aid of a second trigger signal $x_2$. In addition, control or regulating device 43 is connected to starter 41 and throttle device 27, so that it is able to trigger starter 41 with the aid of a third trigger signal $x_3$, and to trigger throttle device 27 for adjusting an opening degree of throttle device 27 with the aid of a fourth trigger signal $x_4$. Individual sensors 31, 33, 39 are likewise connected to control or regulating device 43. As a result, a pressure-sensor signal p from pressure sensor 31, an air-mass flow sensor signal m from air-mass flow sensor 33, as well as an angle-of-rotation sensor signal n from angle-of-rotation sensor 39 are able to be transmitted to control or regulating device 41.

When internal combustion engine 11 is running, piston 15 is in the back-and-forth movement, arrow 37, and crankshaft 35 in corresponding rotary motion 38. Back-and-forth movement 37 is delimited by a top dead center at which a volume of combustion chamber 17 is minimal, and by a bottom dead center at which the volume of combustion chamber 17 is maximal. Internal combustion engine 11 operates according to the 4-stroke principle. In other words, in a gas-exchange phase, exhaust gas (arrow 49) is expelled from combustion chamber 17 into exhaust pipe 23 through open discharge valve 25 in an exhaust stroke in which the piston is moving from bottom dead center to top dead center, and in an intake stroke following the exhaust stroke, air 29 is aspirated from intake manifold 19 into combustion chamber 17 through open intake valve 21. Then, in a working phase when valves 21, 25 are closed, the air inside combustion chamber 17 is compressed in a compression stroke. In a subsequent expansion stroke of the working phase, the gas inside combustion chamber 17 expands.

Angle-of-rotation sensor 39 detects rotary motions of crankshaft 35 and generates angle-of-rotation sensor signal n. Angle-of-rotation sensor signal n has a pulse whenever crankshaft 35 has rotated about a specific angle. Furthermore, angle-of-rotation sensor signal n contains information about the direction of rotation and information as to whether the crankshaft has exceeded a specific absolute reference angle. Control or regulating device 43 evaluates angle-of-rotation sensor signal n and continuously determines an instantaneous absolute angle $\alpha$ of crankshaft 35. Furthermore, control or regulating device 43 ascertains an instantaneous position of piston 15. Using instantaneous angle $\alpha$ of crankshaft 35, control or regulating device 43 controls fuel injector 45 with the aid of first trigger signal $x_1$, and spark plug 47 with the aid of second trigger signal $x_2$, in such a way that fuel is injected into combustion chamber 17 and fired there when piston 17 is in the region of top dead center of its working phase. The precise duration of the injection as well as the precise firing instant are specified as a function of an operating state of internal combustion engine 11. The operating state of internal combustion engine 11 is determined in particular with the aid pressure-sensor signal p generated by pressure sensor 31, and air-mass flow sensor signal m generated by air-mass flow sensor 33. To influence a charge of combustion chamber 17, control or regulating device 43 controls throttle device 27 with the aid of fourth trigger signal $x_4$ in such a way that a particular opening degree of throttle device 27 is adjusted.

If internal combustion engine 11 is temporarily not required, for instance because the motor vehicle is standing briefly, then internal combustion engine 11 is stopped temporarily (start-stop operation). To stop internal combustion engine 11, control or regulating device 43 inhibits any injection of fuel into combustion chamber 17 by appropriate triggering of fuel injectors 45 and spark plug 47, and it also no longer triggers spark plug 47 for the generation of an ignition spark. Because of this, internal combustion engine 11 comes to a standstill after a specific interval. While internal combustion engine 11 is stopped, control or regulating device 43 and angle-of-rotation sensor 39 continue to be operated so that angle $\alpha$ of crankshaft 34 and thus also the position of piston 15 are known. That is to say, control and regulating device 43 has knowledge of the position of piston 15 and also of the position of three additional pistons of combustion engine 11 (not shown) at all times. In the specific embodiment illustrated, angle-of-rotation sensor 39 is implemented in such a way that movements of crankshaft 35 caused by external driving of combustion engine 11 are detected even if combustion engine 11 is driven counter to its normal direction of movement (arrow 38).

As soon as combustion engine 11 is required again, it should start up again as quickly as possible with as little support of starter 41 as possible (direct start). A rapid direct startup requires the selection of starting cylinder 13 best suited for the direct start. Starting cylinder 13 is the particular cylinder 13 into which fuel is injected first by fuel injector 45 in the direct startup, and in which the fuel/air mixture inside its combustion chamber 17 is ignited first by spark plug 47. Starting cylinder 13 is selected as a function of the angle of crankshaft 35 during standstill of combustion engine 11 and the charge of cylinder 13.

Figure 2:
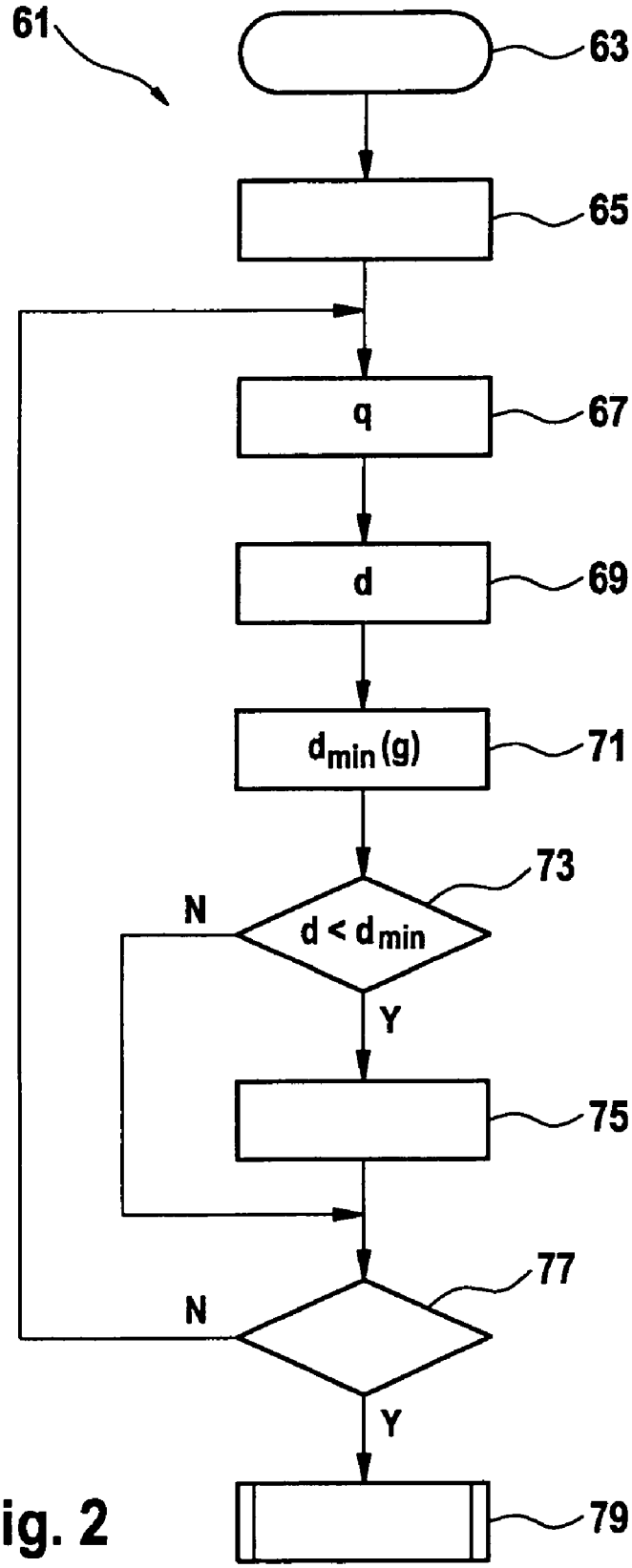
FIG. 2 shows a flowchart of an example embodiment of a method according to the present invention.

A method for selecting starting cylinder 13 is illustrated in FIG. 2 in the form of a flow chart and denoted by reference number 61 overall. In a step 65 following a start 63 of method 61, a preselection of starting cylinder 13 in which a preliminary starting cylinder 13 is specified takes place. In this context, the particular cylinder 13 is selected which has the smallest distance possible to top dead center of the working phase, which distance, however, is still greater than a specified preliminary minimum value. The preliminary minimum value is determined with the aid of a charge characteristics map described below, in that this minimum value is read out of the charge characteristics map for a specified charge (such as 100%, for instance).

Then, in a step 67, an instantaneous charge q of the starting cylinder is ascertained. To this end, an initial value of the charge of the starting cylinder is first determined, which corresponds to an instantaneous charge q at the instant when the standstill of combustion engine 11 begins. Specifically taken into account in this context are sensor signal p from pressure sensor 31 and sensor signal m from air-mass flow sensor 33 and, if required, also the opening degree of throttle device 27 adjusted with the aid of fourth control signal $x_4$. Likewise taken into account is the fact that instantaneous charge q of cylinder 13 decreases over time during the standstill of combustion engine 11 since an overpressure present in combustion chamber 17 decreases due to leaks especially between cylinder 13 and piston 15. In the specific embodiment shown, this time dependency of the charge of cylinder 13 is modeled with the aid of a time constant starting with the initial value. The time constant is determined by suitable measurements prior to taking combustion engine 11 into operation. This time constant typically is on the order of a few seconds. In a variant, instead of the single time constant, it is also possible to use a plurality of time constants defined for a plurality of time periods. In addition, a further characteristics map, which describes the time dependency of the charge, may be provided in place of the time constants.

Once instantaneous charge q has been determined, a distance d between the piston of the starting cylinder and a specified position is calculated (step 69). In the specific embodiment shown, the specified position corresponds to top dead center of the starting cylinder in the working phase, but in other specific embodiments another specified position may be selected as well. Then, in a step 71, a minimum distance $d_{min}$ between the piston of the starting cylinder and the top dead center is determined as a function of the charge ascertained in step 67. A charge characteristics map, which includes value pairs, is used for this purpose, each value pair being made up of an individual value for the charge and a corresponding value for minimum distance $d_{min}$. These value pairs are used as nodes when determining minimum distance $d_{min}$. Values of minimum distance $d_{min}$ for which the characteristics map provides no value pairs, are calculated with the aid of suitable computation methods, in particular interpolation methods.

In a step 73 following step 71, it is checked whether actual distance d between piston 15 of starting cylinder 13 and top dead center is less than minimum distance $d_{min}$. If this is the case (Y), another cylinder 13, i.e., the particular cylinder 13 that follows starting cylinder 13 in the firing sequence, is selected as starting cylinder 13 in a step 75. Otherwise (N), step 75 is skipped. In a step 77, it is then checked whether a direct-start request is present. Such a direct-start request may, for instance, be triggered in that the driver of a motor vehicle actuates an accelerator. If a direct-start request is present (Y), then a direct-start routine 79 will be executed. In direct-start routine 79, control or regulating device 43 activates starter 41 with the aid of third control signal $x_3$, so that it drives combustion engine 11.

Control or regulating device 43 then ascertains a required fuel quantity to be injected into starting cylinder 13 as a function of determined instantaneous charge q. From the required fuel quantity, a corresponding injection period for injecting the required fuel quantity into combustion chamber 17 is then calculated. Using first control signal $x_1$, control or regulating device 43 thereupon initiates an injection into starting cylinder 13 at a suitable time interval whose length corresponds to the calculated injection duration, and via second control signal $x_2$, firing of the air/fuel mixture present in combustion chamber 17 of starting cylinder 13 at a suitable instant.

After the firing, the piston of start cylinder 13 generates a torque at crankshaft 35 to drive combustion engine 11, so that it starts up within a short time, and driving of combustion engine 11 by starter 41 will no longer be necessary. Following the start, control or regulating device 41 deactivates starter 41 by appropriate control via third control signal $x_3$.

If no direct-start request is present (N) in the check in step 77, then a return to step 67 takes place. The selection of starting cylinder 13 is therefore checked repeatedly while combustion engine 11 is at standstill and, if appropriate, a new starting cylinder 13 is selected in a change in instantaneous charge q of selected starting cylinder 13. These checks are repeated until the direct-start request is present. This loop provided in method 61 thus has the result that the selection of starting cylinder 13 is adapted to instantaneous charge q, which varies over time, of the currently selected starting cylinder.

Figure 3:
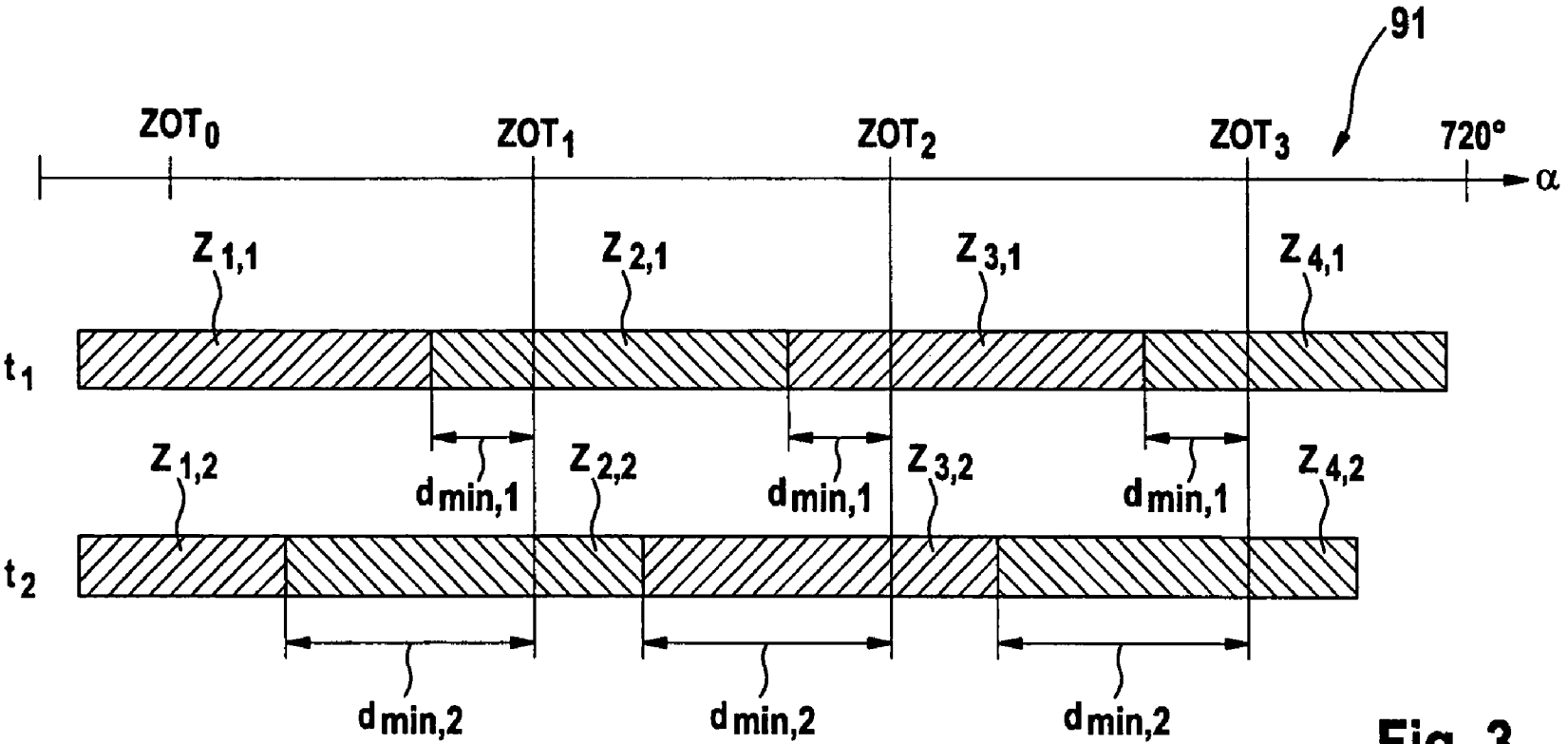
FIG. 3 shows a graphic representation of a selection of a starting cylinder as a function of a crankshaft position and the time.

FIG. 3 shows the selection decision of method 61 changing over time, in a schematic illustration. The angle of crankshaft 35 in relation to a specific reference angle ($\alpha$=0) is plotted on an abscissa 91. Furthermore, the individual angles $ZOT_0$, $ZOT_1$, $ZOT_2$, $ZOT_3$ of crankshaft 35, which correspond to top dead center in the working phase of the individual cylinders, are plotted on abscissa 91.

In addition, ranges of angle $\alpha$ of crankshaft 35 have been identified by bars for different instants $t_1$, $t_2$, in which individual cylinders 13 are selected as starting cylinder 13. For instance, the bar denoted by $Z_{1,1}$ indicates the particular angular range in which first cylinder 13 of combustion engine 11 is selected as starting cylinder 13. It can be seen that first cylinder 13 remains selected only until distance d between its piston and top dead center is greater than time-dependent minimum distance $d_{min,1}$. As a result, second cylinder 13, which follows first cylinder 13 in the firing sequence (bar $Z_{2,1}$), is selected as starting cylinder 13 for angles $\alpha$ of crankshaft 35 in which minimum distance $d_{min,1}$ for the first cylinder is not attained. At the later instant $t_2>t_1$, instantaneous charge q of starting cylinder 13 has dropped. As a result, a larger minimum distance $d_{min,2}$ is determined in the loop of method 61. At instant $t_2$, the second cylinder following the first cylinder in the firing sequence (cf. bar $Z_{1,2}$ and bar $Z_{2,2}$) must be selected already at a smaller angle $\alpha$ of crankshaft 35. Additional bars in FIG. 3 mark angular ranges of angle $\alpha$ of crankshaft 35 in which method 61 selects as starting cylinder 13 the third and the fourth cylinder 13 of combustion engine 11. In this context, a bar $Z_{i,j}$ marks the range of angle $\alpha$ of crankshaft 35 in which cylinder i=1, . . . , 4 is selected as starting cylinder 13 at instant $t_j$, j=1.

What is claimed is:

1. A method for operating a direct-injection internal combustion engine having a plurality of pistons displaceable inside corresponding cylinders, into which cylinders fuel is injected directly, the method comprising:

determining a standstill position of at least one piston inside a cylinder during a standstill of the internal combustion engine;

initially selecting a cylinder as a starting cylinder into which fuel is injected first for a start following the standstill;

determining an instantaneous charge of the starting cylinder as a function of a duration of the standstill of the internal combustion engine;

calculating a distance between the piston of the starting cylinder and a predetermined position of the piston;

determining a minimum distance of the piston of the initially selected cylinder as a function of the instantaneous charge; and selecting another cylinder as the starting cylinder if the distance between the piston of the initially selected starting cylinder and the predetermined position is less than the minimum distance.

2. The method as recited in claim 1, wherein, if the distance between the piston of the initially selected starting cylinder and the predetermined position is less than the minimum distance, then another cylinder whose piston is at a greater distance to the predetermined position than the piston of the initially selected starting cylinder is selected as the starting cylinder.

3. The method as recited in claim 2, wherein the another cylinder selected has a piston which is at a distance to the predetermined position that differs the least from the distance between the piston of the initially selected starting cylinder and the specified position.

4. The method as recited in claim 2, wherein the another cylinder is selected as the starting cylinder no more than once.

5. The method as recited in claim 2, wherein the method is repeated for different successive time points, and wherein at each time point another cylinder is selected as the starting cylinder if the distance between the piston of the initially selected starting cylinder and the predetermined position is less than the minimum distance.

6. The method as recited in claim 2, wherein the minimum distance of the piston of the initially selected starting cylinder is determined with the aid of a characteristics map.

7. The method as recited in claim 2, wherein the determining the instantaneous charge of the starting cylinder includes:

ascertaining an initial charge of the initially selected starting cylinder at an instant when the standstill of the combustion engine begins; and reducing the initial charge in a time-dependent manner, as a function of the duration of the standstill.

8. The method as recited in claim 2, wherein the another cylinder selected as the starting cylinder has a piston which is (a) at the shortest distance from the predetermined position and (b) at a distance which is still larger than a predetermined minimum value.

9. A control device for controlling operation of a direct-injection internal combustion engine having a plurality of pistons displaceable inside corresponding cylinders, into which cylinders fuel is injected directly, the method comprising:

a determining arrangement configured to determine a standstill position of at least one piston inside a cylinder during a standstill of the internal combustion engine;

a selection arrangement configured to initially select a cylinder as a starting cylinder into which fuel is injected first for a start following the standstill;

a determining arrangement configured to determine an instantaneous charge of the starting cylinder as a function of a duration of the standstill of the internal combustion engine;

a calculation arrangement configured to calculate a distance between the piston of the starting cylinder and a predetermined position of the piston;

a determination arrangement configured to determine a minimum distance of the piston of the initially selected cylinder as a function of the instantaneous charge; and a selection arrangement configured to select another cylinder as the starting cylinder if the distance between the piston of the initially selected starting cylinder and the predetermined position is less than the minimum distance.

* * * * *